United States Patent [19]

Kresse

[11] 4,059,604

[45] Nov. 22, 1977

[54] SEPARATION OF MATURE OKRA SEED INTO COMPONENT FRACTIONS

[76] Inventor: Herman J. Kresse, 7602 Marinette, Houston, Tex. 77074

[21] Appl. No.: 745,936

[22] Filed: Nov. 29, 1976

[51] Int. Cl.[2] ..... C11B 1/10

[52] U.S. Cl. ..... 260/412.4; 209/10; 209/172; 210/44; 210/73 R; 241/9; 241/20; 241/79.1; 426/482; 426/484

[58] Field of Search ..... 209/172, 173, 10; 210/44; 241/9, 20, 24, 79.1; 426/482, 483, 484, 518; 260/412.2, 412.4

[56] References Cited

U.S. PATENT DOCUMENTS

| | | | |
|---|---|---|---|
| 515,542 | 2/1894 | Webb | 209/173 |
| 985,745 | 2/1911 | Lefferts | 209/172 |
| 1,789,354 | 1/1931 | Dorner | 241/9 |
| 2,028,132 | 1/1936 | Bienenstock | 209/172 |
| 2,132,484 | 10/1938 | Kober | 209/172 |
| 2,241,737 | 11/1939 | Romberg | 209/173 |
| 2,422,657 | 6/1947 | Cleveland | 209/173 |
| 2,482,141 | 9/1949 | Boatner | 209/172 |
| 2,579,526 | 12/1951 | Vix | 241/20 |
| 3,348,675 | 10/1967 | Tveter | 209/172 |
| 3,481,960 | 12/1969 | Kinsey et al. | 260/412.4 |
| 3,732,108 | 5/1973 | Eapen | 426/518 |

OTHER PUBLICATIONS

Coal Age, vol. 43, No. 5, Foulke, "New Cleaning Process", pp. 74–79.

*Primary Examiner*—Wilbur L. Bascomb, Jr.
*Assistant Examiner*—Ernest G. Therkorn
*Attorney, Agent, or Firm*—Fulbright & Jaworski

[57] ABSTRACT

The present invention is directed to a method for separating mature okra seed into its essential basic components of oil, germ, kernel material and hull. The separation is obtained by cracking the seed in, or immersing previously cracked seed in a liquid medium having a specific gravity of 1.3 plus or minus 0.2 at 60° F. The liquid medium may be an aqueous solution adjusted with sodium chloride, sugar, or other water soluble organic material. However, in order to extract the oil, a solvent such as 1,1,1,-trichloroethane or a blend of trichlorotrifluoroethane and hexane is suitable. The liquid medium will separate the cracked components because of the differences in density of the various components. The hulls will sink in the liquid, and the germ and kernel floats or remains suspended in the liquid. The germ and kernel is then decanted from the hulls, the oil and liquid solvent is separated from the solids by a filter and the oil is extracted from the liquid solvent.

2 Claims, No Drawings

SEPARATION OF MATURE OKRA SEED INTO COMPONENT FRACTIONS

BACKGROUND OF THE INVENTION

Green okra pods together with immature seeds have been utilized for foods for centuries. Yet the food value of the pods is comparatively low, having a protein content of about 1.8%, a fat content of about 0.2%, and a carbohydrate content of 7.4%. Mature okra seed, that is okra seed allowed to mature on the okra plant in the dried pod, has a protein content of about 25–30%, a fat or oil content of about 16–18%, and a carbohydrate content of about 6–9%. Furthermore, mature okra seed production can be mechanically cropped which lends itself to efficient and economical production. While applicant has prepared okra flour from the whole seed and from the deoiled seed, more attractive and usable products can be prepared, if the seed is separated into its main components of oil, germ, kernel material and hulls.

The present invention is directed to separating mature okra seeds into their basic components which will provide for the utilization of a hitherto undeveloped and unexploited foodstuff, that is mature okra seeds and permit production of various food products made from the components of the mature okra seed which are suitable for consumption by humans.

The desired separation of the okra seed is performed by mixing the ground up seed into a liquid medium which has a specific gravity such that the differences in the density of the different seed components causes the components to be separated. Separation of materials by differences in their densities in a liquid is old as shown in U.S. Pat. Nos. 2,482,141; 2,579,526; and 2,028,132. However, the separation of okra seed into components suitable for human consumption requires that a liquid medium be used that is not deleterious to the food, one that may be essentially completely removed from the food after separation, and preferably one that is a solvent that has an affinity for the okra oil.

SUMMARY

The present invention is directed to provide a method for separation of mature okra seed into the components of oil, germ, kernel and hull so that the various components may be used to make attractive and useful food products.

A still further object is the method of separating mature okra seed into its basic components by cracking the seed in, or immersing previously cracked seed in a liquid medium having a specific gravity of 1.3 plus or minus 0.2 at 60° F. whereby the hull material will separate to the bottom of the liquid, the germ will separate to the top surface of the liquid, and the kernel material separates to the top or remains essentially suspended in the liquid.

While the seed components may be separated by any suitable liquid medium having the desired specific gravity such as an aqueous solution of sodium chloride, a sugar or heavy alcohol aqueous solution, a solution of alcohol and glycerin, it is preferable to have a liquid medium which extracts the oil such as 1,1,1,trichloroethane or a mixture of trichlorotrifluroethane and hexane.

A further object of the present invention is to decant the germ, kernel and liquid from the hull and filter the germ-kernel-liquid mixture to further separate the liquid therefrom. The oil may then be separated from the liquid.

Other and further objects, features and advantages will be apparent from the following description of preferred embodiments of the invention given for the purpose of disclosure.

DESCRIPTION OF THE PREFERRED EMBODIMENTS

The desired separation of the okra seed into one or more of its component fractions such as oil, germ, kernel material and hulls is achieved by placing the seed in a liquid medium having a specific gravity of 1.3 plus or minus 0.2 at 60° F. Best separation is achieved at a specific gravity of 1.38–1.45. The seed may be ground or cracked prior to insertion in the liquid medium or while in the liquid medium. For example, whole seeds may be inserted into a variable speed Waring type food blender and initially the whole okra seeds will float on the surface. When the blender is activated, preferably at a low speed, the seeds will be fractured into relatively large particles. Fracturing of the okra seeds to completion is noted by the absence of whole okra seeds at the upper surface of the liquid. Thereafter, the blender is deactivated and the difference in densities of the components relative to the specific gravity of the liquid causes three separations to occur simultaneously. The hull materials sink to the bottom of the liquid, the germ or embryo floats on top of the liquid and the kernel material floats under the germ or remains suspended in the liquid.

Since it is desired to utilize the components of the okra seed for food, the liquid medium that is used must be one that is not deleterious to the food and must be one that may be essentially completely removed from the food after separation, or that any residue of the liquid medium remaining is not harmful to humans or other animals that may consume the food products. One suitable liquid is an aqueous solution of sodium chloride adjusted to the desired specific gravity. However, in the use of an aqueous solution of sodium chloride, the okra oil is not extracted, but remains in the germ-kernel material and may be subsequently removed or allowed to remain if desired. Other suitable non-solvent liquid mediums are an aqueous solution of sodium chloride or sugar, such as sucrose, or any aqueous solution plus light hydrocarbon phase. An organic solution consisting of alcohol such as ethyl alcohol and glycerin or heavier alcohol is also suitable.

If desired, the liquid medium may be of a nature which extracts the fats or oils from the fractured seed whereby four different fractions of the seeds may be obtained in one operation, namely, the hulls, germ, kernel material and oil dissolved in the liquid. One satisfactory solvent is a mixture of chlorinated fluorocarbon and hexane. A liquid of preferable choice is trichlorotrifluroethane and hexane. This particular liquid has a relatively low boiling point when compared to the extracted oil and may be completely and easily removed by evaporation leaving the okra oil. The removal of this particular liquid medium requires relatively low energy and may be recovered for reuse in the process. Another suitable liquid is 1,1,1,trichloroethane which has a higher boiling point and consequently requires more energy for removal. However, both of these latter solvent liquid mediums are not deleterious to foods, can be easily and substantially completely removed from the feed components after separation, and are not harmful to humans.

After the germ, kernel and hull have been separated in the liquid medium, the germ, kernel material and liquid are decanted from the hull and poured into a filter, such as a Buechner type filter. The residue in the funnel of the filter contains essentially two layers of material, the germ is the upper layer and the kernel material as the lower layer. These layers can then be easily separated if desired.

As previously mentioned, if a non-solvent liquid is used, the oil will not separate but will remain with the germ and kernel material. The hull contains no oil. However, if the liquid medium has a solvent, the oil will be extracted from the germ and kernel material and will be in solution with the liquid. Therefore, after the filtering step, the liquid will contain the solvent plus the okra oil which may then be extracted from the solvent.

The following examples will now illustrate the advantages and utility of the present invention:

EXAMPLE I

One hundred grams of mature okra seed with a moisture content of 1.0% was placed in a Waring blender. Five hundred mls. of 1,1,1,trichloroethane was placed in the blender with the okra seed. The seed was ground in the 1,1,1,trichloroethane at medium speed. Initially, the seed floated on the liquid. During grinding, the whole seed gradually disappears from the surface of the mixture. When no whole seed is seen floating on the surface, grinding is complete. The blender motor is turned off and the hulls settle quickly to the bottom of the blender while the kernel and germ material are floating and are then decanted with the fluid from the hull. The decanted mixture is then filtered through a Buechner filter to separate the fluid containing the oil from the germ-kernel material. The oil is separated from the 1,1,1,trichloroethane by distilling, the oil remains as residue. The resulting yield is about 17 grams of oil, 48 grams of hull material, and 35 grams of germ-kernel material.

EXAMPLE II

The same procedure was followed as in Example I except that the moisture content of the mature okra seed was 3%. The resulting yield was about 18.5 grams of oil, 47 grams of hull material, and 35.5 grams of germ-kernel material.

EXAMPLE III

One hundred grams of mature okra seed with a moisture content of 1.0% was placed in a Waring blender. Five hundred mls. of an aqueous solution of sodium chloride having a specific gravity of 1.3 was placed in the blender with the okra seed and ground at medium speed. After grinding, the blender was turned off, the hulls settled to the bottom while the kernel and germ material floated in the fluid and were decanted from the hulls. The fluid and the germ-kernel material were filtered, but since the oil was not extracted by the sodium chloride solution, no oil was present in the filtrate and the oil remained in the germ-kernel material. The yield was about 43 grams of hull material and 57 grams of germ-kernel material.

EXAMPLE IV

The same procedure and amounts of okra seed and liquid were used as in Example I except that the solution was a mixture of trichlorotrifluroethane and hexane in a proportion to provide a specific gravity of 1.3. The resultant filtrate of oil and fluids was easily separated by distillation and the solution of trichlorotrifluroethane and hexane may be recovered and reused. The yield was approximately the same as in Example I.

EXAMPLE V

Examples I, II, III and IV were performed as before, but the mature okra seed was ground in a separate operation prior to mixture with the separation liquids in the Waring blender and the results were substantially the same as in Examples I, II, III and IV.

EXAMPLE VI

The same procedure and amounts of okra seed and liquid were used as in Example III except that the solution was a mixture of sugar and water in a proportion to provide a specific gravity of 1.3. The yield was approximately the same as in Example III.

EXAMPLE VII

The same procedure and amounts of okra seed and liquid were used as in Example I except the solution was a mixture of glycerin and water in a proportion to provide a specific gravity of 1.3. The yield was approximately the same as in Example I.

The present invention, therefore, is well adapted to carry out the objects and attain the ends and advantages mentioned as well as others inherent therein. While presently preferred embodiments of the invention are given for the purpose of disclosure, numerous changes in the details of operation can be made which will readily suggest themselves to those skilled in the art and which are encompassed within the spirit of the invention and the scope of the appended claims.

What is claimed is:

1. A method of separating mature okra seeds into various components comprising,
   - mixing broken up mature okra seeds with a liquid medium of a mixture of trichlorotrifluorethane and hexane adjusted to a specific gravity of 1.3 plus or minus 0.2 at 60° F. whereby the liquid medium extracts the oil from the broken up okra seed,
   - ceasing the mixing of the broken up seed with the liquid to allow the seed components to separate due to their differences in density whereby the hulls sink to the bottom of the liquid, the germ floats on top of the liquid, and the kernel floats or remains in suspension in the liquid,
   - decanting the solution of liquid and germ and kernel material from the hulls,
   - filtering the liquid from the germ and kernel components, and
   - separating the oil from the liquid medium.

2. A method of separating mature okra seeds into various components comprising,
   - mixing broken up mature okra seeds with a liquid medium of 1,1,1,trichloroethane adjusted to a specific gravity of 1.3 plus or minus 0.2 at 60° F. whereby the liquid medium extracts the oil from the broken up okra seed,
   - ceasing the mixing of the broken up seed with the liquid to allow the seed components to separate due to their differences in density whereby the hulls sink to the bottom of the liquid, the germ floats on top of the liquid, and the kernel floats or remains in suspension in the liquid,
   - decanting the solution of liquid and germ and kernel material from the hulls,
   - filtering the liquid from the germ and kernel components, and
   - separating the oil from the liquid medium.

* * * * *